US005330688A

United States Patent [19]

Downs

[11] Patent Number: 5,330,688

[45] Date of Patent: Jul. 19, 1994

[54] FLEXIBLE DIFFUSER ASSEMBLY FOR AERATION APPLICATIONS

[75] Inventor: Ernest W. Downs, Cincinnati, Ohio

[73] Assignee: Enviroquip International, Inc., Cincinnati, Ohio

[21] Appl. No.: 67,844

[22] Filed: May 27, 1993

[51] Int. Cl.[5] ..... B01F 3/04

[52] U.S. Cl. ..... 261/122.2; 261/122.1

[58] Field of Search ..... 261/122.2, 122.1

[56] References Cited

U.S. PATENT DOCUMENTS

| | | | |
|---|---|---|---|
| 2,639,131 | 5/1953 | Coombs | 261/122.1 |
| 3,997,634 | 12/1976 | Downs | 261/122.1 |
| 4,007,240 | 2/1977 | Gosden | 261/122.1 |
| 4,046,845 | 9/1977 | Beeder | 261/122.1 |
| 4,842,779 | 6/1989 | Jager | 261/122.2 |
| 4,849,139 | 7/1989 | Jager | 261/122.2 |
| 5,075,048 | 12/1991 | Veeder | 261/122.1 |
| 5,204,028 | 4/1993 | Ruston | 261/122.1 |

OTHER PUBLICATIONS

Sanitaire Water Pollution Control Group Documents, 198,9 Milwaukee, Wis., 3 sheets including Dwg. 89–71.

*Primary Examiner*—Tim Miles
*Attorney, Agent, or Firm*—William B. Noll

[57] ABSTRACT

This invention relates to the combination of an aeration system and flexible diffuser assembly, especially for use in a sewage treatment tank, where the system includes a plurality of fluid medium transmission conduits, with each conduit provided with at least one flange projecting therefrom, where the flange includes a base plate mounted thereto and a central opening communicating with said conduit. The diffuser assembly comprises a first member having a flat continuous annular face portion and a central recess with a bore aligned with the central opening. A locking bolt member is provided to threadably engage the bore and central opening, where the bolt member includes a central, through orifice communicating with the conduit through which the fluid medium may pass. Finally a porous elastomeric cover is provided to lie contiguous with the annular face portion and engage the periphery of the first member, where the cover includes a plurality of perforations, preferably in the form of through slits arranged in plural concentric circles.

10 Claims, 4 Drawing Sheets

FLEXIBLE DIFFUSER ASSEMBLY FOR AERATION APPLICATIONS

BACKGROUND OF THE INVENTION

This invention is directed to an improved flexible diffuser assembly that has particular application in the aeration of a sewage medium. A unique advantage hereof is the ability of the diffuser assembly to be retrofitted to existing aeration systems, specifically the porous ceramic dome, a commercial system sold under the name, SANITAIRE, a registered trademark of Water Pollution Control Corporation of Milwaukee, Wis.

For a number of years one of the methods of introducing air bubbles into a waste water treatment tank, for the express purpose of aerating the waste water, has been through the use of domed porous ceramic diffusers that emit fine bubbles, where such diffusers are secured to an air supply manifold along the bottom of a sewage treatment tank. While these diffusers have worked satisfactorily when new, over a period of time there is a tendency for them to become clogged and thus less efficient. In time the entire plant operation has to be closed down and the domed ceramic diffusers laboriously cleaned to thereby restore the porosity of the ceramic domes to a condition approaching that of new diffusers; a very labor intensive operation. The original design of these domed ceramic diffusers provided for their being bolted to a base plate that in turn had been permanently fixed to an air distribution pipe. This allowed the domed diffuser to be removed and cleaned, or replaced if one had become too clogged to restore, or replaced if one had become damaged. While this method of cleaning the domed diffusers has worked, the down-time for this type of maintenance has proven to be a detriment in the continuity of the operation of the waste water treatment plant.

U.S. Pat. No. 3,997,634, to the inventor of this invention, teaches a diffuser assembly that has gained commercial acceptance since its introduction. Briefly, such assembly comprises a base consisting of a T shaped member formed of "delrin", or similar material, having a central bore therethrough. It is through said bore that the aerating fluid, such as gas, passes for treatment of the surrounding fluid medium. Overlying and contiguous with an annular portion of the top of said T shaped member is a flexible cap or cover, i.e., neoprene or the like, which engages or wraps around the peripheral edge thereof. Plural through holes are provided in the annular portion to permit the release of gas from the diffuser into the treatment medium.

While such diffuser assembly represented a departure from existing treatment systems, it was limited to new construction and it could not be adapted to be retrofitted to existing systems, i.e. existing piping and support mechanism. Not only is the diffuser assembly of this invention, utilizing a flexible diffuser membrane, ideal for in-system replacement of the ceramic dome assembly, it offers comparable performance. That is, the assembly according to this invention will provide an improved oxygen transfer efficiency and pressure headloss without the need to constantly drain the sewage treatment tank to allow cleaning of the diffusers. This will save considerable maintenance costs and reduce the additional energy costs required to deliver air to the ceramic diffusers when they begin to clog.

The advantages hereof will become more apparent in the description which follows, particularly when read in conjunction with the accompanying drawings.

SUMMARY OF THE INVENTION

This invention is directed to a flexible diffuser assembly which is particularly adapted for use in aerating the waste water of a sewage treatment plant. More particularly, this invention relates to the combination of the assembly fixedly secured to an aeration system utilizing a plurality of fluid medium transmission conduits, with each conduit provided with at least one flange projecting therefrom, where the flange includes a base plate mounted thereto and having a central opening communicating with the conduit. The diffuser assembly comprises a first member having a flat continuous annular face portion and a central recess with a bore aligned with the central opening. Securing the first member to the conduit is a locking bolt member threadably engaging the bore and the central opening, where the bolt member includes a central, through orifice communicating with the conduit through which the fluid medium may pass. Finally, a porous elastomeric cover lying contiguous with the annular face portion is provided. The cover is adapted to engage the periphery of the first member and is further provided with a plurality of perforations, preferably in the form of minuscule slots arranged in plural concentric circles. In operation, air passes through the conduit up through the bored locking bolt into the central recess. By this action the flexible cover or membrane is caused to expand or stretch into a dome shape and as it does so, the slots are caused to open slightly providing for the release of air from the diffuser into the fluid medium thereby forming fine bubbles. When the air supply is stopped the flexible membrane will deflate to the flat condition in contact with the first member, which causes the slots to close, thereby stopping any backflow of liquids into the diffuser. When a repair or cleaning of the diffuser becomes necessary, the cap is merely removed and a new one, if needed, is installed.

DETAILED DESCRIPTION OF PREFERRED EMBODIMENT

Figure 1:
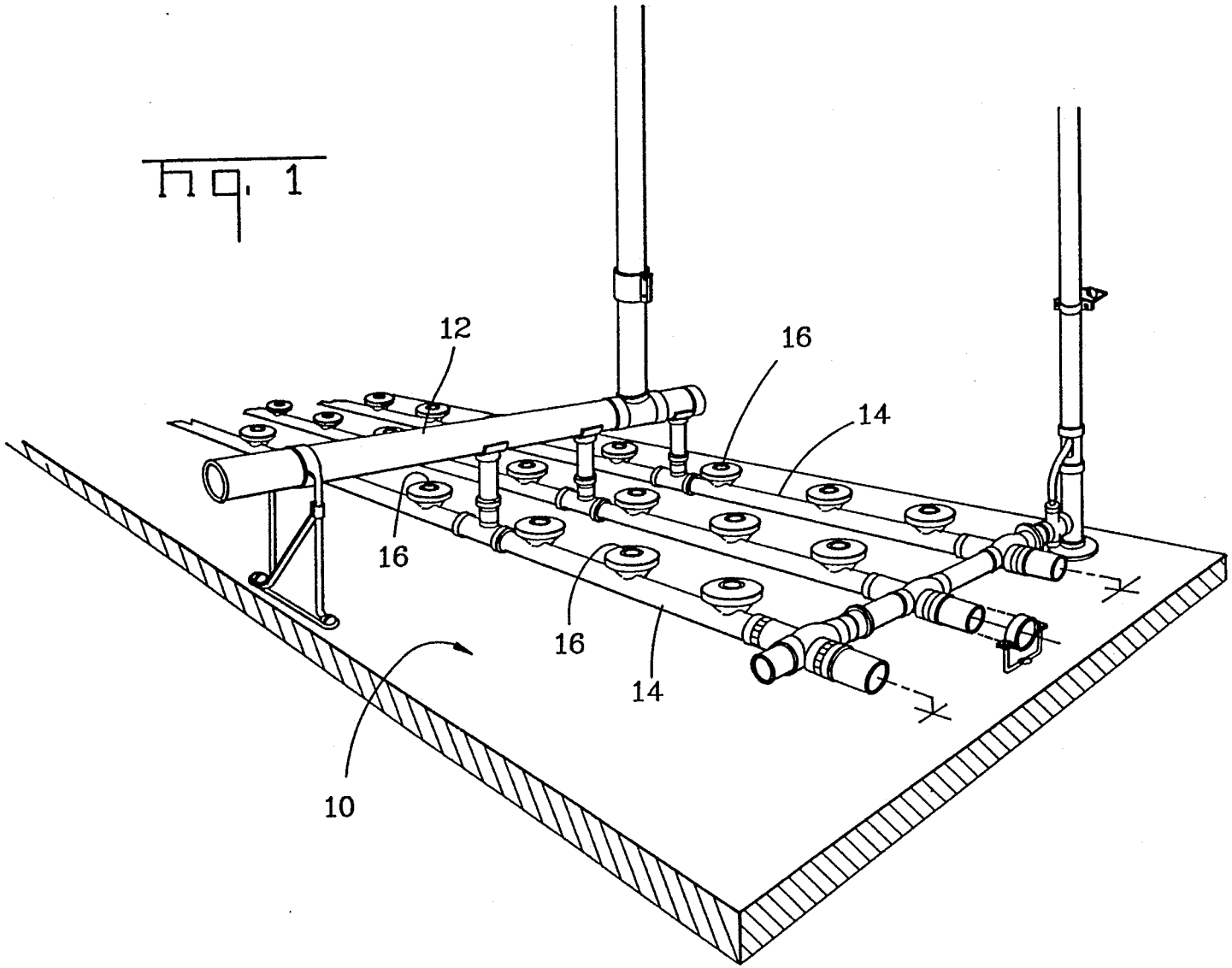
FIG. 1 is a simplified, partially sectioned, perspective view of a conventional sewage treatment tank utilizing the flexible diffuser assembly according to this invention.

FIG. 1 represents the major components of an aeration system for the treatment of sewage. While the invention hereof is applicable to a variety of aeration systems, such as the treatment of chemicals and other industrial wastes, for convenience and understanding the further description will be directed to the treatment of sewage.

The treatment system, a portion of which is illustrated in FIG. 1, includes a treatment tank 10 into which the sewage is placed for treatment, a manifold 12 for bringing the treatment medium, typically air, to a plurality of parallel distribution conduits 14 connected to the manifold 12, and a plurality of flexible diffuser assemblies 16 in accordance with this invention.

Figure 2:
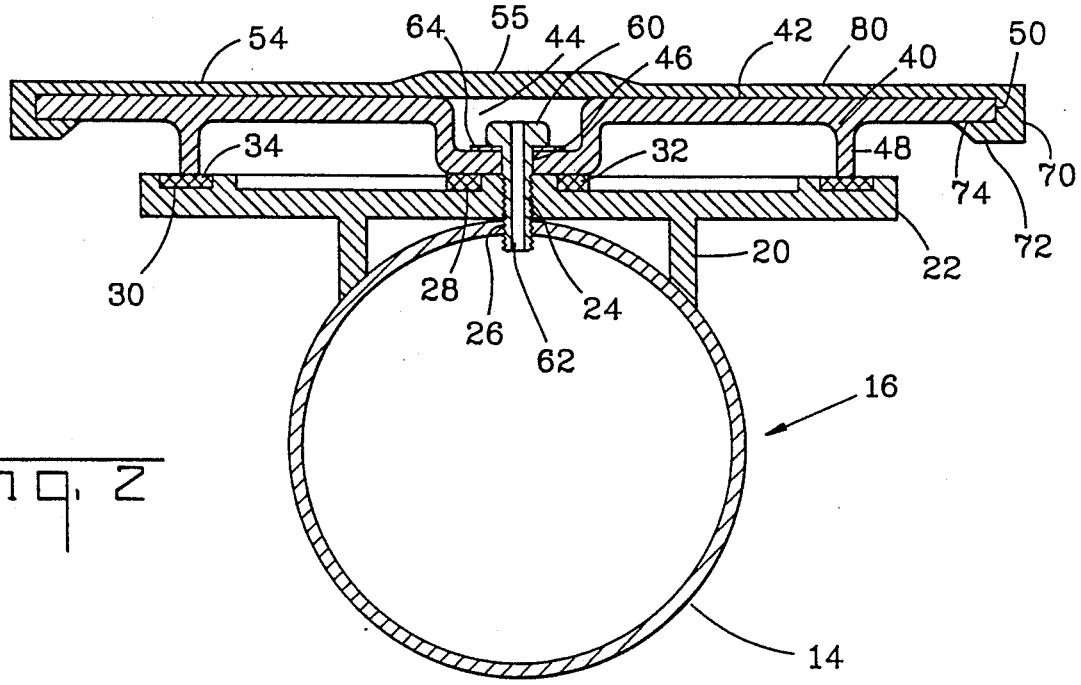
FIG. 2 is a sectional view of the combination of an aeration system and flexible diffuser assembly of this invention, where such assembly is shown in a noninflated condition.

FIG. 2 is a partial sectional view of a preferred flexible diffuser assembly 16. Secured to the distribution conduit 14, for each of the diffuser assemblies, is flange 20 terminating along an upper end with a diffuser base 22. While the sewage submerged components may be fabricated from stainless steel, a material resistant to the sewage environment, it is preferable to use a system resistant plastic material, such as CELCON, a trademark, or UPVC, products known in the art. In any case, whether metal or plastic, the flange 20 is welded, or solvent welded in the case of plastic, to the distribution conduit 14. The flange 20, preferably a continuous circular member, insures balance and stability for the diffuser assembly.

The diffuser base 22 is preferably circular in configuration and includes a central bore 24 aligned with a complementary opening 26 in the distribution conduit 14. In a concentric arrangement about such central bore 24, a pair of circular slots 28, 30 are provided to receive complementary gaskets 32, 34, respectively.

Above said diffuser base 22, a planar membrane support 40 is provided. The support 40, circular in configuration, is characterized by a flat, continuous face portion 42, a central recess 44 having a bore 46 aligned with the central bore 24 and opening 26. Projecting below said support 40 is a circular flange 48, which when the support 40 is aligned with and secured to the diffuser base 22, will rest on the gasket 34 to thereby provide for support and sealing thereof. It will be noted that while the base 40 has been illustrated as flat, it may be non-planar, i.e. dome or convex shaped. This would have certain advantages, such as providing an improved backflow seal.

Figure 4:
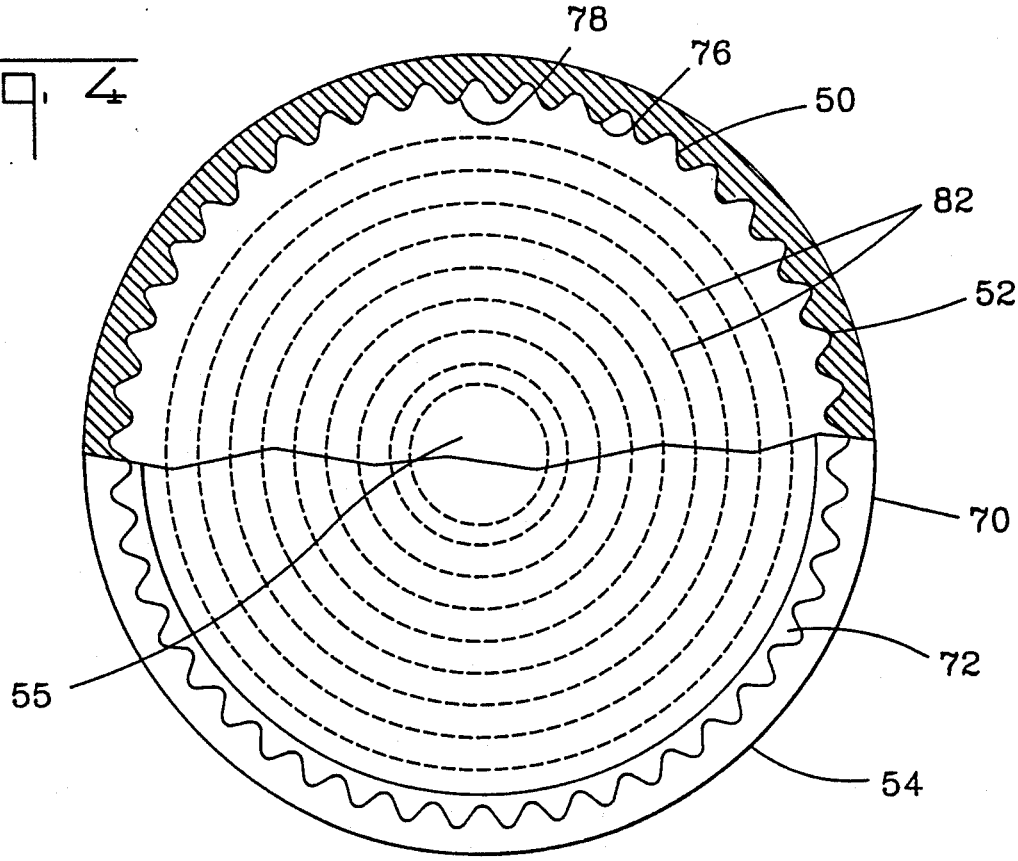
FIG. 4 is a bottom view, partially sectioned, of the perforated flexible cover of FIG. 3.

As illustrated in FIG. 4, the peripheral edge 50 of membrane support 40 is scalloped 52, which, to be explained hereinafter, cooperates with the membrane diffuser cover 54 to secure it against and around the membrane support 40. Returning now to FIG. 2, fastening means 60, preferably in the form of a threaded bolt, is provided to mount the membrane support 40 to the diffuser base 22. The bolt or fastening means 60 includes a through orifice 62 which extends from the chamber of distribution conduit into the central recess 44. For effecting sealing of the bolt 60, which threadably secures the planar membrane support 40 to the diffuser base 22 and conduit 16, gasket or washer 64 is provided to underlie the head of bolt 60.

Figure 3:
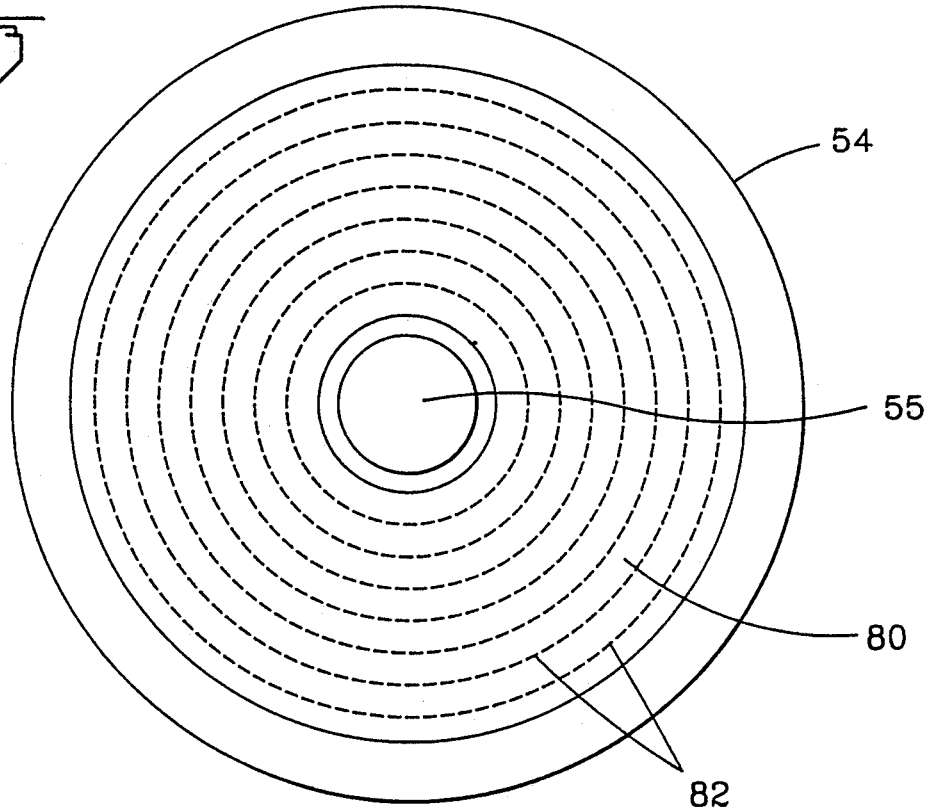
FIG. 3 is a top view of the perforated flexible cover for the diffuser assembly of this invention.

The membrane diffuser cover 54, made of an elastomeric material, such as rubber, is illustrated with top and bottom views in FIGS. 3 and 4, respectively. The cover 54 is circular in configuration, and is further adapted to overlie the continuous face portion 42 and engage the periphery or edge 50. The periphery 70 of cover 54 includes a flanged portion 72, the purpose of which is to grip the underside 74 of membrane support 54. Additionally, as more clearly shown in FIG. 4, where the upper half has been sectioned to illustrate the interfacing edge 76 of cover 54, such edge 76 is scalloped 78 so as to intermate with the complementary scalloping of the peripheral edge 50.

Disposed about the major surface 80 of the cover 54, namely that portion of the cover which overlies the continuous face portion 42, are a plurality of through slits 82 arranged in plural concentric circles thereabout. As apparent in the description which follows, the aerating medium or air is released through the slits 82. In the center 55 of the cover 54, the thickness is preferably increased to give additional support to the cover 54, particularly as such center overlies the central recess 44.

Figure 5:
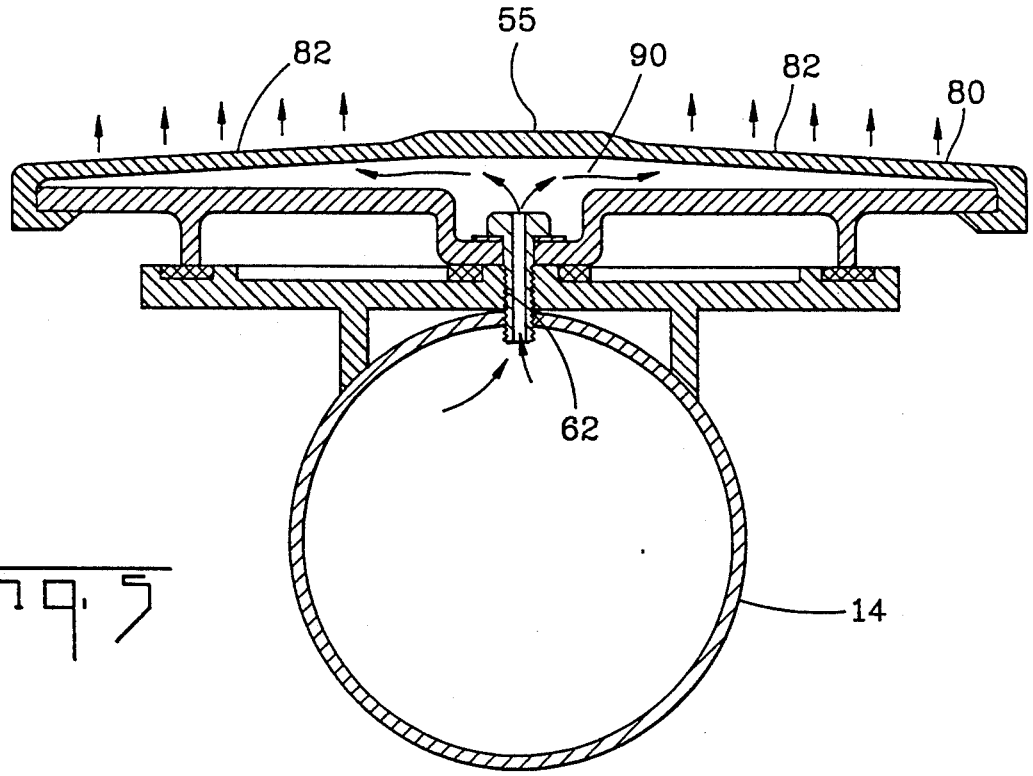
FIG. 5 is a sectional view similar to FIG. 2, showing the diffuser assembly of this invention in an inflated condition.
Figure 6:
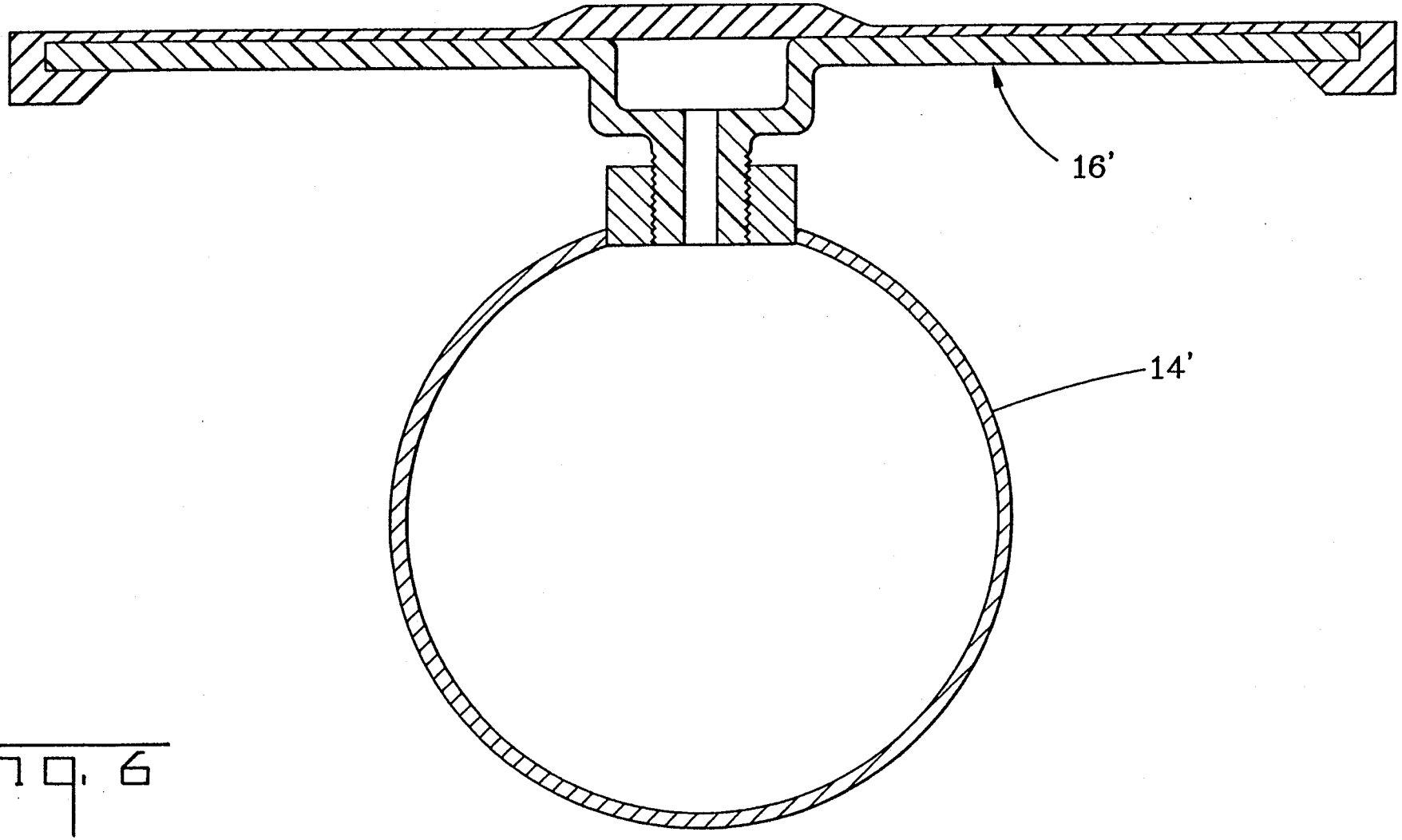
FIG. 6 is a simplified sectional view illustrating the direct attachment of the flexible diffuser assembly to an aeration distribution conduit.

For a clearer understanding of the operation of the flexible diffuser assembly of this invention, reference is made to FIG. 5 and the "flow" arrows added thereto. FIG. 2 represents the condition of inactivity, where the flexible cover 54 lies in sealing engagement with the continuous face portion 42. However, as air, the preferred aeration medium, passes under positive pressure from the conduit 14 up through the orifice 62, the pressure thereof lifts the flexible membrane cover 54 creating an expanded chamber 90. The air therefrom is released through the slits 82 in the cover and into the sewage tank, thereby effecting aeration of the sewage. FIG. 6 illustrates the direct attachment of the diffuser assembly 16' to an aeration distribution conduit 14'.

I claim:

1. In combination with an aeration system utilizing a plurality of fluid medium transmission conduits, with each said conduit provided with at least one flange projecting therefrom, where said flange includes a base plate mounted thereto and a central opening communicating with said conduit, a diffuser assembly comprising
   (1) a first member having a continuous annular face portion, said first member including a central recess with a bore aligned with said central opening,
   (2) a locking bolt member extending through said bore and threadably engaging said central opening, where said bolt member includes a central, through orifice communicating with said conduit through which said fluid medium may pass, and
   (3) a porous elastomeric cover lying contiguous with said annular face portion and engaging the periphery of said first member, where said cover includes a plurality of perforations.

2. The combination according to claim 1, wherein said first member is circular in configuration defined by a continuous edge, and the periphery of said cover wraps around said edge.

3. The combination according to claim 1, wherein said perforations are plural slots arranged in plural concentric circles.

4. The combination according to claim 1, wherein said cover includes a central reinforced portion overlying said central recess.

5. The combination according to claim 1, wherein said central recess defines a first chamber into which said fluid medium flows.

6. The combination according to claim 1, wherein said annular face portion is flat.

7. The combination according to claim 1, wherein said annular face portion is non-planar to provide an improved backflow seal.

8. The combination according to claim 1, wherein said first member includes a flange projecting therefrom in contact with said base plate.

9. The combination according to claim 8, wherein said flange is a continuous circular flange.

10. The combination according to claim 9, wherein gaskets are provided between said flange and said base plate.

* * * * *